US010075792B2

(12) United States Patent
Szmanda

(10) Patent No.: US 10,075,792 B2
(45) Date of Patent: Sep. 11, 2018

(54) APPARATUSES FOR CONTROLLING AND POSITIONING HEARING AID COMPONENTS IN EAR CANALS

(71) Applicant: Jeffrey P. Szmanda, Big Bend, WI (US)

(72) Inventor: Jeffrey P. Szmanda, Big Bend, WI (US)

( * ) Notice: Subject to any disclaimer, the term of this patent is extended or adjusted under 35 U.S.C. 154(b) by 0 days.

(21) Appl. No.: 15/225,010

(22) Filed: Aug. 1, 2016

(65) Prior Publication Data

US 2017/0048630 A1 Feb. 16, 2017

Related U.S. Application Data

(60) Provisional application No. 62/204,043, filed on Aug. 12, 2015, provisional application No. 62/289,433, filed on Feb. 1, 2016.

(51) Int. Cl.
*H04R 25/00* (2006.01)

(52) U.S. Cl.
CPC ..... *H04R 25/65* (2013.01); *H04R 25/60* (2013.01); *H04R 2225/025* (2013.01)

(58) Field of Classification Search
CPC ..... H04R 25/65
USPC ..... 381/324, 329; 132/53
See application file for complete search history.

(56) References Cited

U.S. PATENT DOCUMENTS

2002/0189627 A1* 12/2002 Tang ..... A41G 3/0033 132/53
2006/0215862 A1 9/2006 Hyunh et al.
2007/0003087 A1 1/2007 Ram et al.
2007/0036374 A1 2/2007 Bauman et al.
2009/0082801 A1 3/2009 Giese et al.
2009/0285428 A1 11/2009 Gilgert
2012/0230528 A1 9/2012 Pander et al.

OTHER PUBLICATIONS http://www.libertyhealthsupply.com/gator-grip-hearing-aid-insertion-tool-p/lhs-slc-1.htm.
International Search Report and Written Opinion of PCT/US2016/045019 dated Jan. 11, 2017.

* cited by examiner

*Primary Examiner* — Md S Elahee
(74) *Attorney, Agent, or Firm* — Andrus Intellectual Property Law, LLP

(57) ABSTRACT

An apparatus for controlling and positioning a device in a body cavity includes a cap that increases the maneuverability of the device in the body cavity as the device is positioned in the body cavity. In certain examples, the apparatus for controlling and positioning an ear canal component of a hearing aid in an ear canal includes a cap having a having a plurality of gripping structures and a projection that defines a plurality of grooves between the projection and the plurality of gripping structures; and a sidewall opposite the plurality of gripping structures and defining a cavity configured to receive the ear canal component. The cap and the sidewall are configured to couple with the ear canal component.

18 Claims, 26 Drawing Sheets

APPARATUSES FOR CONTROLLING AND POSITIONING HEARING AID COMPONENTS IN EAR CANALS

CROSS-REFERENCE TO RELATED APPLICATIONS

The present application claims priority to U.S. Provisional Application No. 62/204,043 filed on Aug. 12, 2015 and U.S. Provisional Application No. 62/289,433 filed on Feb. 1, 2016, which are hereby incorporated herein by reference.

FIELD

The present disclosure relates to apparatuses for controlling and/or positioning devices into a living body, specifically apparatuses for controlling and positioning ear canal components in an ear canal.

BACKGROUND

Hearing aids are used to assist a person who has impaired hearing or does not perceive sound properly. Technological advances in hearing aids have reduced their size. Accordingly, many components of the hearing aid are very small making the manipulation and positioning of components within an ear canal difficult.

Generally, there are two types of behind-the-ear hearing aids. Those with receiver-in-the-ear (RITE) (also sometimes called receiver-in-the-canal (RIC)), and those with the receiver-in-the-aid (RITA). Both the RITE and certain RITA hearing aids require a small ear canal component be positioned in the ear canal of the user. The ear canal component can include a sound receiver, a tip (e.g. occluding ear dome, non-occluding ear dome, other suitable component) portions of a wire, portions of an acoustical mini sound tube, and/or other hearing air components that are positioned in the ear canal. In the example of a RITE hearing aid, the receiver and/or the tip are positioned in the ear canal and a thin wire connects the receiver and/or the tip to the main body of the hearing aid. In the example of a RITA hearing aid, a tip (and generally a portion of the acoustical mini sound tube) is positioned in the ear canal, and the tip is connected to the main body of the hearing aid by the acoustical mini sound tube. In this case, the receiver is located in the main body of the hearing aid. Certain examples of hearing aids or ear canal components include a retention tail that maintains the ear canal component in the correct position in the ear canal and/or increases the stability of the ear canal component in the ear canal. Maintaining the ear canal component in position in the ear canal is important as movement of the ear canal (due to the user talking, chewing, leaning over, turning of the head, and/or walking) can cause the ear canal to change shape, and therefore, result in slippage of the ear canal component which may change the performance of the hearing aid.

Regardless of whether a RITE or RITA hearing aid is utilized by a user, it is essential that ear canal component be property inserted and positioned in the ear canal. The ear canal component must be seated correctly to ensure that the hearing aid user is receiving the prescribed amplification and the hearing aid is secure.

Presently, it can be very difficult for hearing aid users to insert, control, position, and seat the ear canal component of a hearing aid sufficiently deep into the ear canal for a variety of reasons. Attempts have been made to make the process of positioning the ear canal component using a variety of devices including tweezers, holding rods, and insertion tools. However, hearing aid users intuitively use their fingertips to push the ear canal component into place in the ear canal. The use of a fingernail also can further assist the user when pushing the ear canal component into place in the ear canal. Often times however, the use of a fingertip and/or fingernail to position the ear canal component can result in user frustration, inability to manipulate the ear canal component, and/or too much effort by the user due to the lack of an adequate surface area and accommodations for a fingertip and/or fingernail to manipulate and position the ear canal component.

Furthermore, the small size of the ear canal component makes it very difficult for the user to manipulate and control the orientation and position of the hearing aid component as the user attempts to direct the ear canal component through the angled and sloped pathways of the ear canal. For instance, a user may have several angles, bends, or curves in the ear canal. Furthermore still, dexterity or mobility limitations of older hearing aid users make the ability to manipulate and position the ear canal component even more difficult and frustrating.

The ear canal component also lacks adequate surface area for a fingertip to manipulate the movement of the ear canal component. For instance, fingertip may slide past and alongside the ear canal component making manipulation of the ear canal component nearly impossible.

Further, it should be noted that many components of the hearing aid, such as the ear canal components, the connector wire, and acoustical mini sound tube, are often very delicate. Substantial force on any component may cause damage, malfunction, and/or destruction of the hearing aid. Often times, a twisting motion is used by a user to attempt to achieve proper positioning, but this twisting motion can cause substantial damage to the hearing aid component.

The resulting consequences of the problems described above for hearing aid users include loosely fitting hearing aids which may fall out and become lost, inadequate amplification which does not meet the prescribed needs of the hearing aid user, unwanted acoustical feedback, user frustration, damage to the hearing aid, diminished reputation for the hearing aid manufacturer, and/or reduced perception of the viability of hearing aids by users.

Example prior attempts at solving the problems discussed above have been disclosed in U.S. Patent Publication Nos. 2009/0285428 and 2009/0082801, both incorporated herein by reference. However, both disclosures have their own problems. It is also conceivable that these handheld tools may cause injury to the user if improperly inserted into the ear canal. For instance, inserting a tool too deeply into the ear canal may rupture to the tympanic membrane (ear drum) and/or injure the surface of the ear canal. Also, the user may lose the handheld tool.

SUMMARY

This Summary is provided to introduce a selection of concepts that are further described herein below in the Detailed Description. This Summary is not intended to identify key or central features of the claimed subject matter, nor is it intended to be used as an aid in limiting the scope of the claimed subject matter.

In certain examples, an apparatus for controlling and positioning a device in a body cavity includes a cap configured to couple to the device such that the cap increases maneuverability of the device in the body cavity as the device is positioned in the ear canal.

In certain examples, an apparatus for controlling and positioning an ear canal component of a hearing aid in an ear canal includes a cap having a having a plurality of gripping structures and a projection that defines a plurality of grooves between the projection and the plurality of gripping structures; and an annular sidewall opposite the plurality of gripping structures and defining a cavity configured to receive the ear canal component. The cap and the sidewall are configured to couple with the ear canal component.

In certain examples, an ear canal component of a hearing aid that is positioned in an ear canal includes a cap configured to increase maneuverability and control of the ear canal component as the ear canal component is positioned in the ear canal.

BRIEF DESCRIPTION OF THE DRAWING

Examples of the present disclosure are described with reference to the following drawing FIGURES. The same reference numbers are used throughout the FIGURES to reference like features and components.

DETAILED DESCRIPTION

Figure 1:
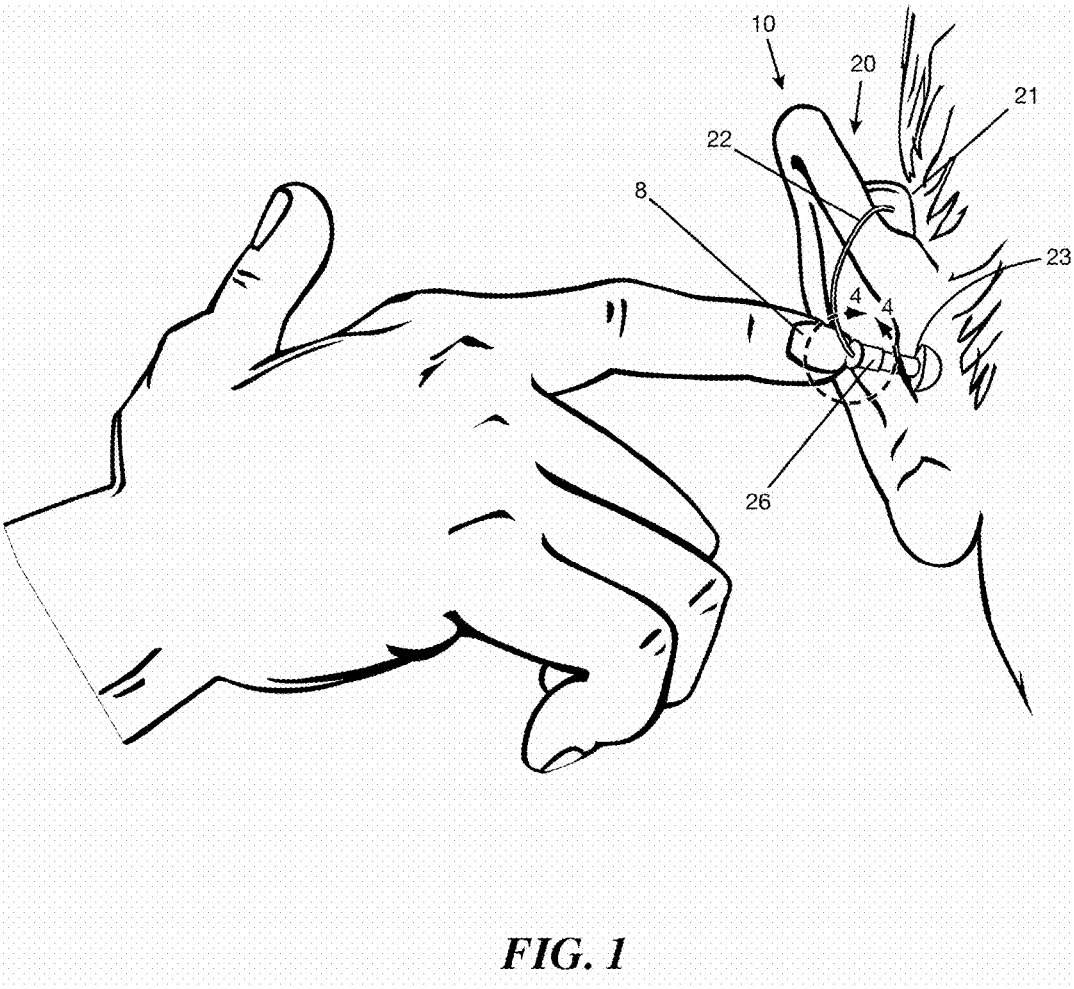
FIG. 1 is an example hearing aid with an example apparatus of the present disclosure coupled to an ear canal component.

In the present disclosure, certain terms have been used for brevity, clarity and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

The present disclosure is described herein using several definitions, as set forth below and throughout the application. Unless otherwise specified or indicated by context, the terms "a", "an", and "the" mean "one or more." For example, "a compound" should be interpreted to mean "one or more compounds."

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus ≤10% of the particular term and "substantially" and "significantly" will mean plus or minus >10% of the particular term.

As used herein, the terms "include" and "including" have the same meaning as the terms "comprise" and "comprising" in that these latter terms are "open" transitional terms that do not limit claims only to the recited elements succeeding these transitional terms. The term "consisting of," while encompassed by the term "comprising," should be interpreted as a "closed" transitional term that limits claims only to the recited elements succeeding this transitional term. The term "consisting essentially of," while encompassed by the term "comprising," should be interpreted as a "partially closed" transitional term which permits additional elements succeeding this transitional term, but only if those additional elements do not materially affect the basic and novel characteristics of the claim.

The inventor has discovered through research and experimentation that it is advantageous for a hearing aid to include an apparatus that allows a user to control and position an ear canal component of the hearing aid into an ear canal. More specifically, the apparatus is an ergonomically designed fingertip fitting guide that couples to the ear canal component to increase the control of the ear canal component while the user positions the ear canal component into the ear canal. The apparatus can prevent damage to the hearing aid (such as the ear canal component) and/or sensitive ear structures.

It is noted that the use of the term "fingertip" and/or "fingernail" in this disclosure does not limit the scope of the present disclosure to the specific body part referred to. A fingertip, fingernail, and/or another part of a human extremity can be used to contact, position, and manipulate the apparatus described herein. It should also be noted that the application of the present disclosure discussed herein does not limit the scope of the present disclosure and the example application to an ear and/or ear canal is used herein for purposes of context such that it will be recognized by those of ordinary skill that other applications (e.g. nasal cavity, vaginal cavity, anal cavity) and/or uses of the present disclosure may find similar advantages for devices or items (e.g. suppositories) that are positioned in other body cavities. It should also be recognized by those of ordinary skill in the art that the embodiments set forth herein are merely examples and not intended to be limiting.

Referring to FIG. 1, a device or hearing aid 20 with a fingertip or fingernail guide or apparatus 26 (described herein) is depicted inserted into the human ear 10. The hearing aid 20 includes a main body 21, an ear canal component 23, and a connector 22 (e.g. wire, acoustical mini sound tube) which couples the ear canal component 23 to the main body 21. The main body 21 of the hearing aid 20 includes other components of the hearing aid 20 including a power source, electronic processing equipment, and/or the like. The ear canal component 23 can include a receiver, a tip, portions of the connector 22, and/or other hearing aid components that are positioned in an ear canal 15 (see FIG. 3). Certain examples of hearing aids 20 or ear canal components 23 include a retention tail 24 (see FIG. 13) that maintains the ear canal component 23 in position in the ear canal 15 and/or increases the stability of the ear canal component 23.

Figure 2:
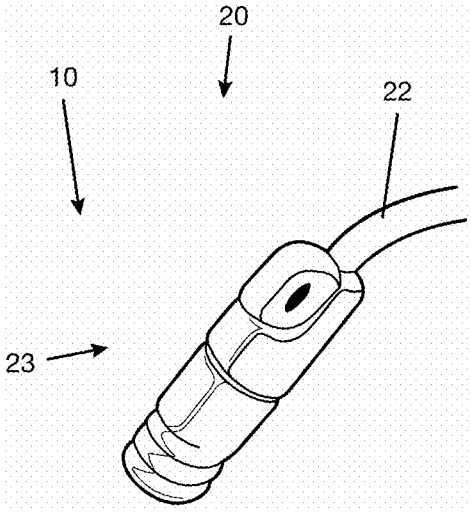
FIG. 2 is an example ear canal component.

Referring to FIG. 2, an example ear canal component 23 is depicted, specifically a receiver and a portion of the connector 22 of the hearing aid 20.

Figure 3:
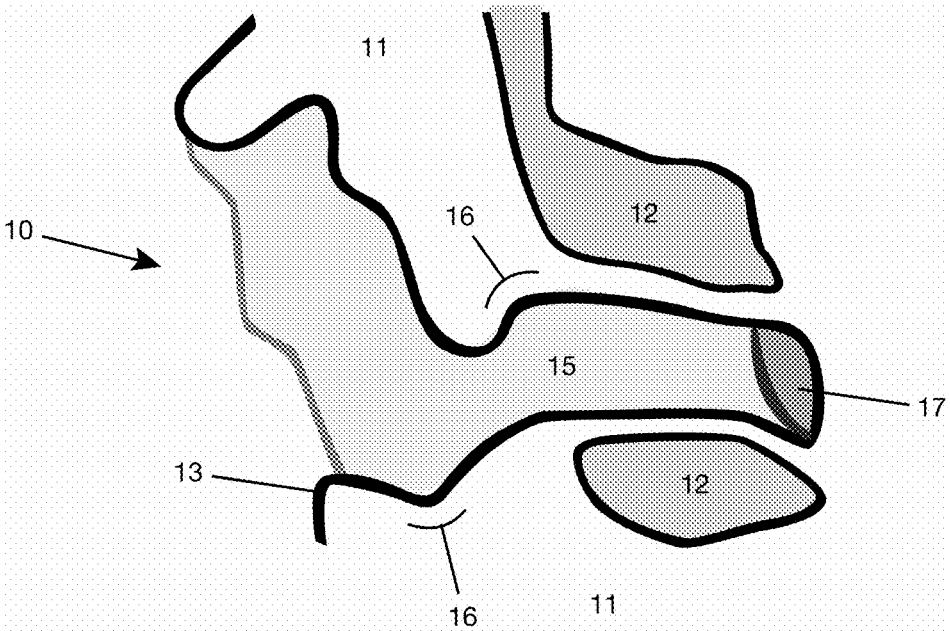
FIG. 3 is a cross sectional view of a typical human ear.

Referring to FIG. 3, a typical cross sectional view of a human ear 10 is depicted. The ear 10 includes cartilage 11, bones 12, a tragus 13, bends 16, an ear canal 15, and an ear drum 17. For proper sound amplification, the ear canal component 23 (see FIG. 1) must be inserted into the ear canal 15 and manually controlled, manipulated, and positioned sufficiently deep in the ear canal 15. The apparatus 26 assists in manipulating and positioning the ear canal component 23 into the ear canal 15. In one example, the user uses a fingernail 8 (see FIG. 1) to engage the apparatus 26. In other examples, the user can use other body parts and objects such as a tool, a tweezer, and/or the like to engage and/or contact the apparatus 26.

Referring to FIGS. 4, 5, 6A-6H, 7A-7C, 8A-8C, and 9A-9C, example apparatuses 26 are shown in greater detail. The apparatus 26 is coupled to the ear canal component 23 and is utilized when positioning the ear canal component 23 of the hearing aid 20 into the ear canal 15. The apparatus 26 includes a guide member or cap 28 configured to couple to the ear canal component 23 such that the cap 28 supports the fingernail 8 and increases maneuverability of the ear canal component 23 in the ear canal 15 as the ear canal component 23 is positioned in the ear canal 15. The cap 28 includes a contact surface 29 that is contacted by the fingernail 8 such that the fingernail 8 does not slip as the user positions the ear canal component 23 in the ear canal 15. The contact surface 29 can be a smooth surface or a textured surface such as etching, crosshatching, roughen surfaces, bumps, undulations, depressions, and/or the like. The cap 28 includes a concave endwall 30 (described further herein) opposite the contact surface 29. The cap 28 can be any size and/or shape (e.g. circular, disc, spherical, triangular, rectangular). The apparatus 26 can be coupled to the ear canal component 23 by adhesive, friction, compression (i.e. the apparatus 26 elastically deforms when placed on the ear canal component 23 such that that apparatus 26 tightly grips the ear canal component 23 such that the apparatus 26 is not easily removed), mechanical connection devices (e.g. screws), and/or the like. In other examples, the apparatus 26 may be integral with the ear canal component 23 (e.g. the apparatus 26 can be integral with a molded plastic cover of the receiver; the apparatus 26 can be integral with the dome of the hearing aid; the apparatus 26 can be integral with the ear canal component 32). The apparatus 26 can be made of any suitable material such as elastic materials, rubber, silicon, flexible plastic, rigid plastic, ceramic, metal, and/or the like.

Figure 4:
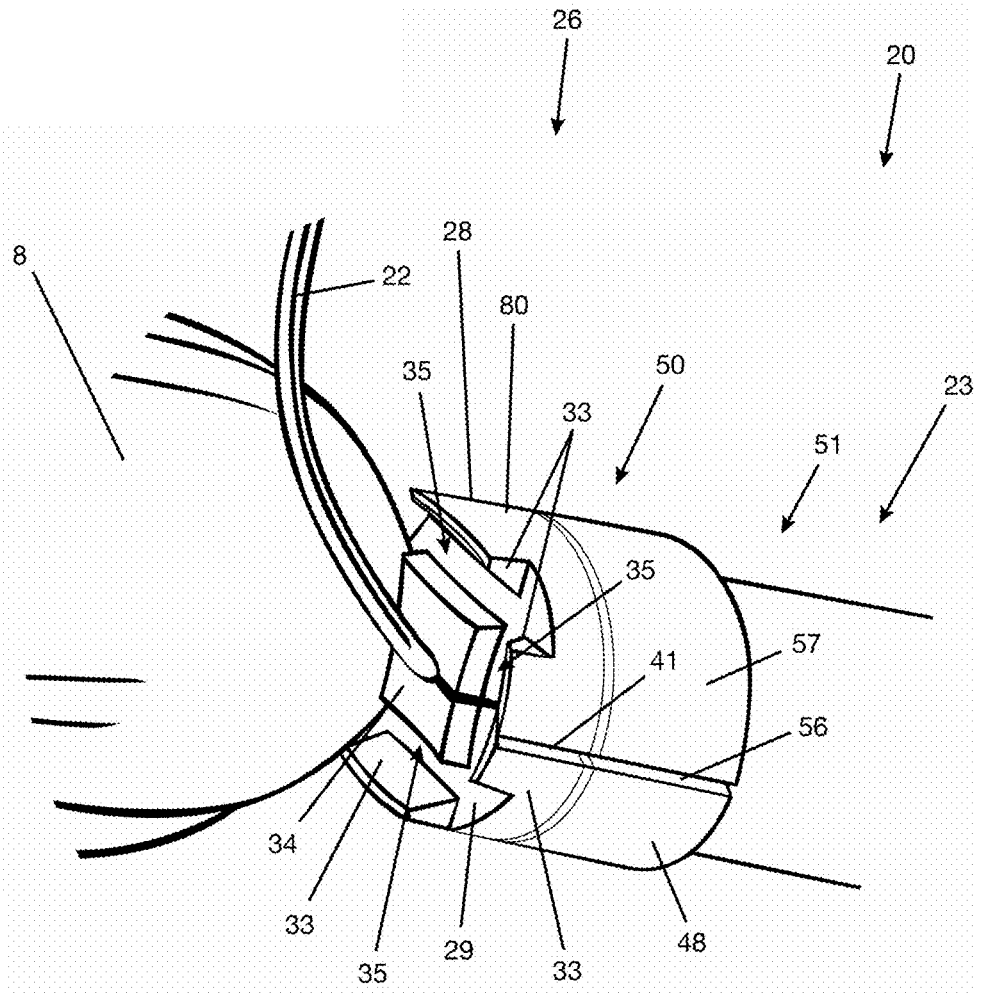
FIG. 4 is an enlarged view of the apparatus of FIG. 1 taken about 4-4 on FIG. 1.
Figure 5:
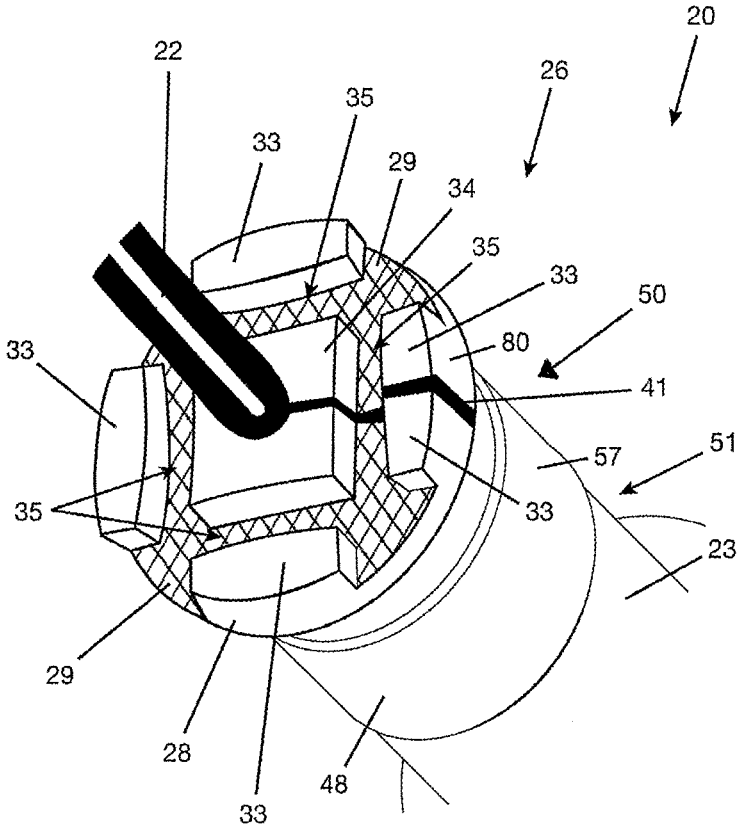
FIG. 5 is a perspective view of an example apparatus of the present disclosure.

The cap 28 includes a gripping structure 33 that projects outwardly from the contact surface 29 of the cap 28. Any number of gripping structures 33 can be included with the cap 28. The gripping structures 33 can be any suitable size and/or shape (e.g. rectangular, circular, triangular, concave). In certain examples, the gripping structures 33 are truncated (see FIG. 4). The gripping structure 33 includes a first end that is adjacent to the contact surface 29 and a second end opposite the first end. The second end of the gripping structure 33 includes a sloped surface that slopes toward the first end from an outer edge 80 (see FIGS. 4-5) of the cap 28 towards the center of the cap 28. The cap 28 includes a step or projection 34 that projects outwardly from the cap 28 and defines a groove 35 between the projection 34 and the gripping structure 33. The fingernail 8 can be received in the groove 35 between the projection 34 and the gripping structure 33. The illustrated number of gripping structures 33 and/or projections 34 included with the cap 28 is merely exemplary and can vary from that which is shown. For example, FIG. 4 depicts three gripping structures 33 (one gripping structure 33 is hidden by the depicted fingernail 8) and FIG. 5 depicts four gripping structures 33. In certain examples, the cap 28 may be devoid of gripping structures 33. In certain examples, the projection 34 and a plurality of gripping structures 33 define a plurality of grooves 35 between the projection 34 and the plurality of gripping structures 33. In certain examples, the grooves 35 are shaped to receive a curved fingernail 8 (e.g. the groove 35 is arc shaped having curvature similar to the curvature of a typical fingernail). The gripping structures 33 and/or the projection 34 can comprise the same material as the rest of the apparatus 26 or different materials.

The cap 28 defines a connector hole 40 (see FIG. 7A) and includes a cap slit 41 that intersects the connector hole 40. The connector hole 40 receives the connector 22 of the hearing aid 20 (see FIG. 2). The size and/or shape of the connector hole 40 can vary based on the dimensions of the ear canal component 23 (e.g. the connector hole 40 is circular or oval in shape). In certain examples, the diameter of the connector hole 40 is equal to the diameter of the connector 22. The connector hole 40 can be located in the center of the cap 28 on a center axis (not shown). In other examples, the connector hole 40 is radially offset from the center of the cap 28.

The cap slit 41 intersects the connector hole 40 and the outer edge 80 of the cap 28. The cap 28 is configured to elastically deform as the cap 28 couples to the ear canal component 23 such that the cap slit 41 opens whereby the user can position the connector 22 into the connector hole 40. When the connector 22 has been properly received in the connector hole 40, the cap slit 41 returns to a closed position such that the connector 22 is not easily moved from the connector hole 40 without an appropriate force and/or the apparatus 26 is not easily removed from the connector 22 and/or the ear canal component 23. In a closed position, two surfaces of the cap slit 41 can contact each other. In certain examples, the cap slit 41 is a cut in the cap 28 between the connector hole 40 and the outer edge 80 that defines two surfaces that abut each other in the closed position and separate from each other in an open position. In other examples, a space or gap may separate the two surfaces of the cap slit 41.

The apparatus 26 includes a sidewall 48 coupled to the cap 28. The sidewall 48 engages and/or couples to the ear canal component 23, and the sidewall 48 defines a cavity 49 that is configured to receive the ear canal component 23. In certain examples, the cap 28 includes the concave endwall 30 that defines a closed end 50 of the cavity 49 (see FIG. 6E). The sidewall 48 is configured to couple with the ear canal component 23 by surrounding or encircling the ear canal component 23. The sidewall 48 couples to the ear canal component 23 by adhesive, friction, compression (i.e. the sidewall 48 elastically deforms when coupled to the ear canal component 23 such that the sidewall 48 tightly grips the ear canal component 23 and the apparatus 26 is not easily removed), mechanical connection devices (e.g. screws), and/or the like. In one example, the sidewall 48 elastically deforms as the user stretches the sidewall 48 around the ear canal component 23. The sidewall 48 can be any size and/or shape. In certain examples, the sidewall 48 is annular. The sidewall 48 can be made of any suitable material such as elastic materials, rubber, silicon, flexible plastic, rigid plastic, ceramic, metal, and/or the like. The sidewall 48 can be made from the same material of the cap 28 or made from a different material.

Figure 10A:
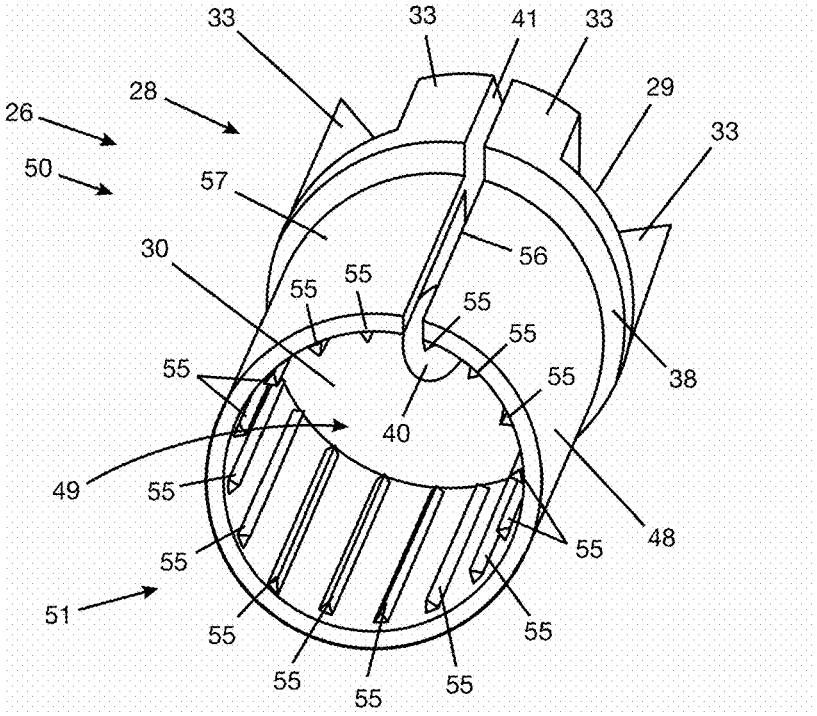
FIG. 10A is an end perspective view of an example apparatus of the present disclosure with ribs in an undeformed position.
Figure 10B:
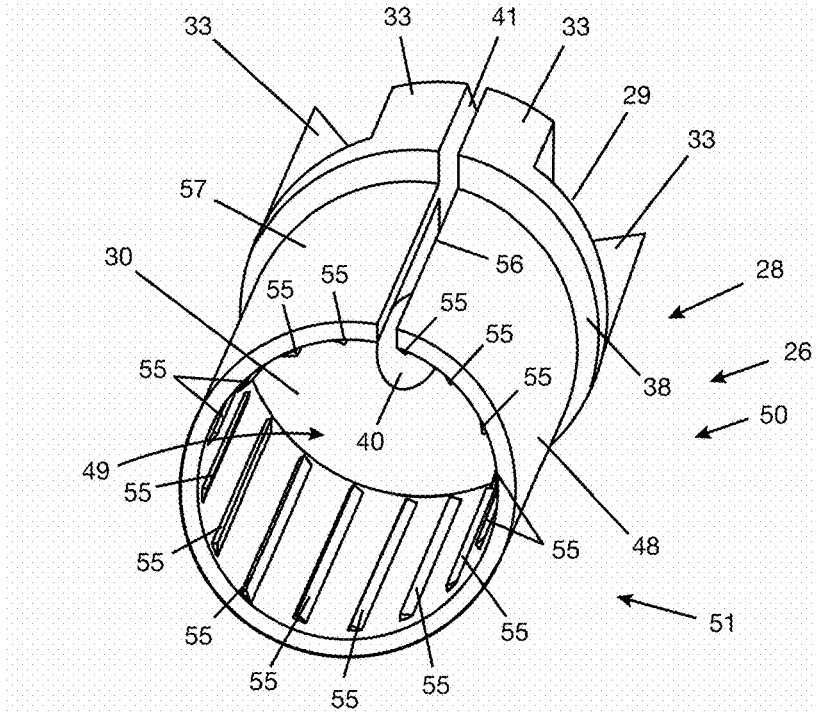
FIG. 10B is an end perspective view of the example apparatus of FIG. 10A with the ribs in a deformed position.

Referring to FIGS. 6E, 10A, 10B, 11A, and 11B, the sidewall 48 can include a plurality of fins or ribs 55 that project into the cavity 49 and are configured to deform as the cavity 49 receives the ear canal component 23 such that the ribs 55 couple to and/or engage with the ear canal component 23. The ribs 55 are integrally coupled to the sidewall 48 and are made of any suitable material. The structure (e.g. projections, detents, suction cups, textured pads), size, and/or the shape of the ribs 55 can vary. For example, the ribs 55 depicted in FIGS. 10A and 10B are smaller and have a different shape when compared to the ribs 55 depicted in FIGS. 11A and 11B. In certain examples, the ribs 55 can be stepped in height and/or width such that the rib height and/or width increases from an open end 51 of the cavity 49 to the closed end 50 of the cavity 49 such that engagement or coupling between the ribs 55 and the ear canal component 23 increases as the ear canal component 23 is inserted further into the cavity 49.

Figure 11A:
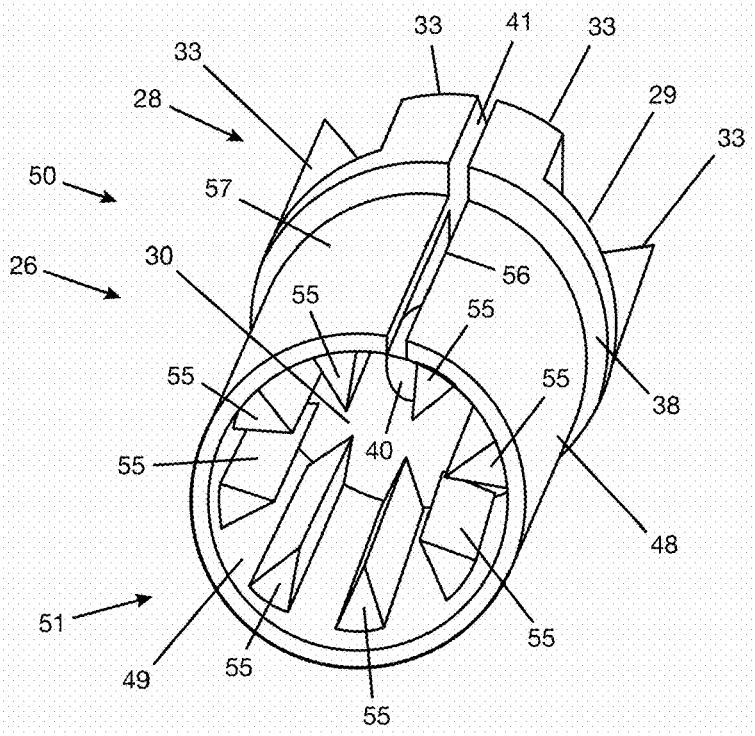
FIG. 11A is an end perspective view of an example apparatus of the present disclosure with ribs in an undeformed position.
Figure 11B:
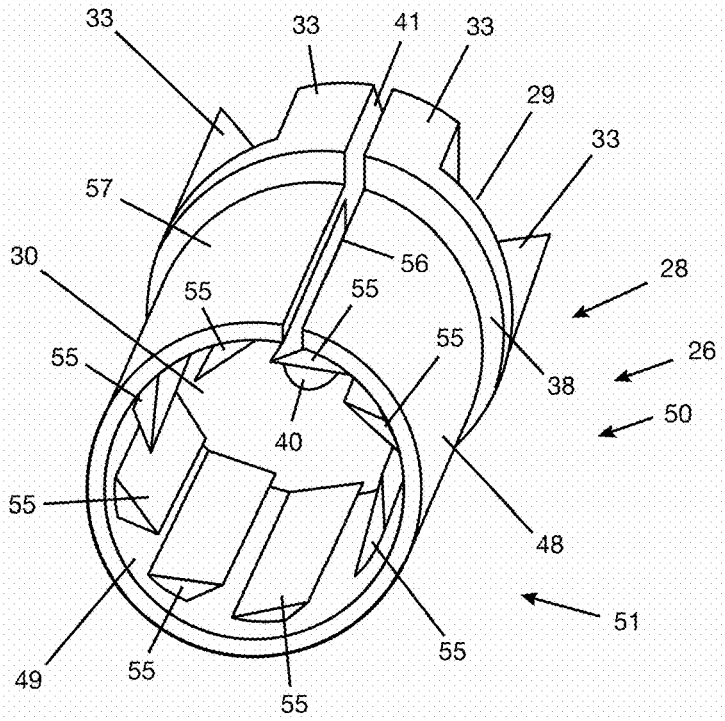
FIG. 11B is an end perspective view of the example apparatus of FIG. 11A with the ribs in a deformed position.

Referring to FIGS. 10A and 11A, the ribs 55 are depicted in an erect or undeformed position. Referring to FIGS. 10B and 11B, the ribs 55 are depicted in a collapsed or deformed position such as when the ear canal component 23 is received by the cavity 49. The ribs 55 deform, collapse, are received in pockets (not shown), and/or move relative each other while moving from the undeformed position to the deformed position. In certain examples, the ribs 55 fold onto or overlap adjacent ribs 55. In certain examples, the ribs 55 fold or collapse into pockets (not shown). The ribs 55 are configured to accommodate ear canal components 23 having different shapes and sizes (i.e. a single apparatus 26 having the sidewall 48 with the ribs 55 accommodates several different ear canal components 23 manufactured by different hearing aid manufacturers). Often, hearing aid manufacturers manufacture various hearing aids 20 with different attributes (e.g. size, dimensions, shapes).

Figure 15:
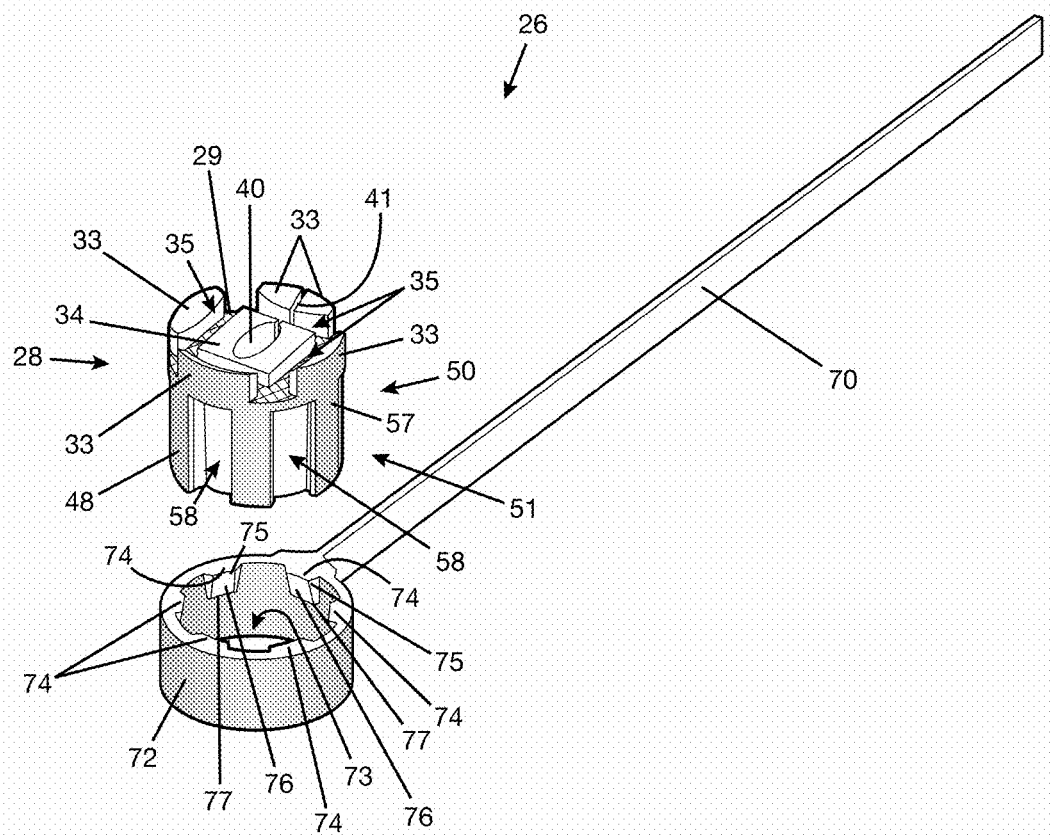
FIG. 15 is an example apparatus of the present disclosure having a retention tail adjacent to a cap and a sidewall.
Figure 16:
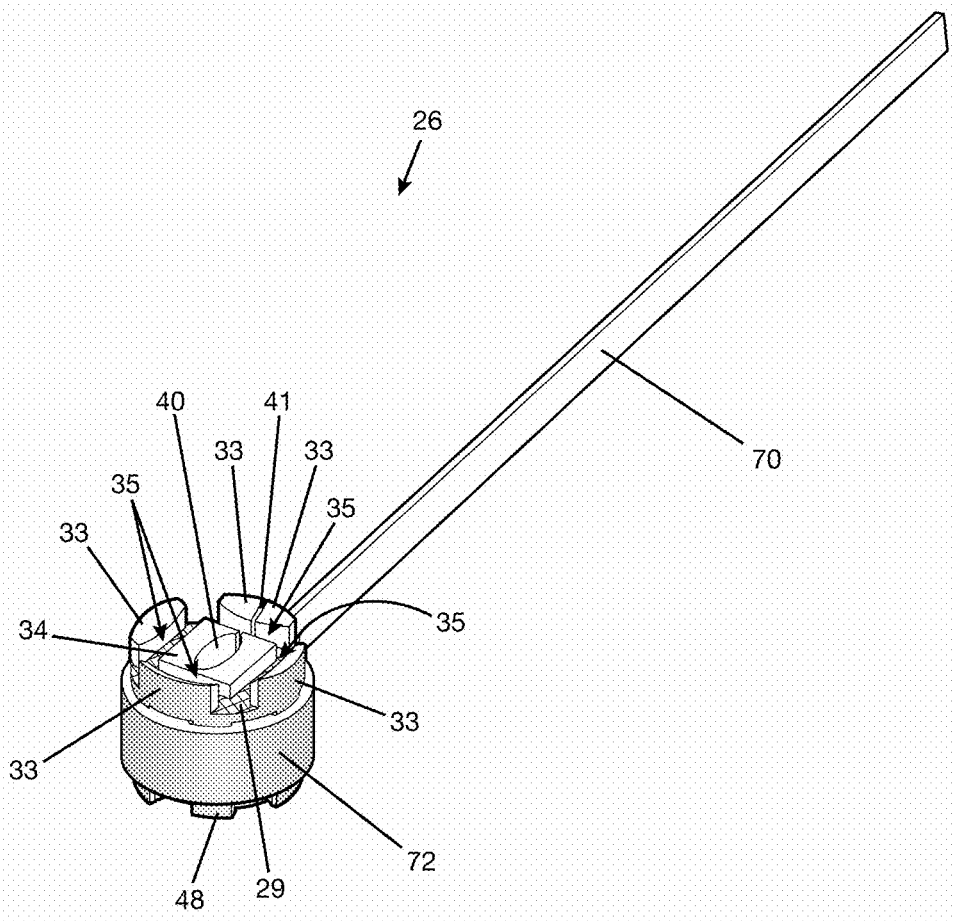
FIG. 16 is the apparatus of FIG. 15 with the retention tail of FIG. 15 coupled to the sidewall.

Referring to FIGS. 15-16, the sidewall 48 includes an outer surface 57 that defines sidewall channels or slots 58. The sidewall channels 58 are opposite the ribs 55 relative to the sidewall 48. The sidewall channels 58 receive and/or mate with fingers 74 of a retention tail 70 (to be described below).

Figure 9A:
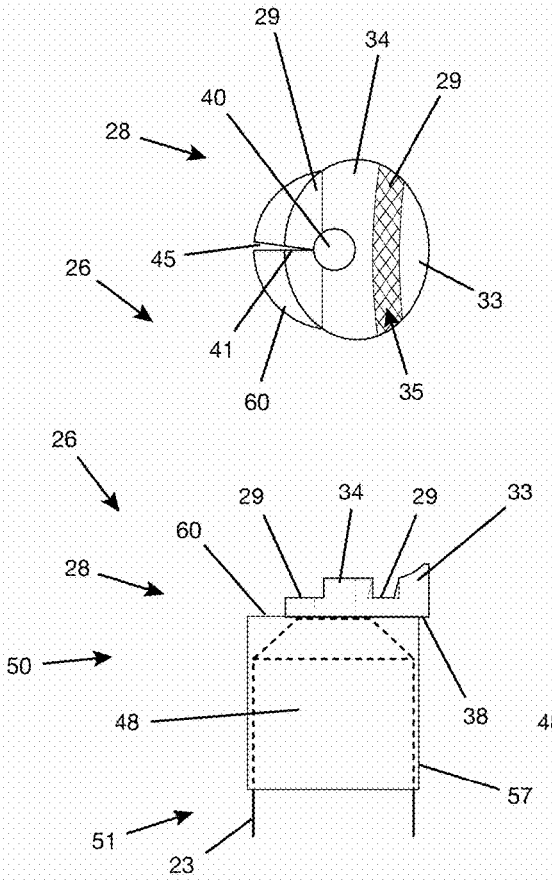
FIG. 9A is a side view and a top view of an example apparatus of the present disclosure coupled to an ear canal component having a rounded top.
Figure 9B:
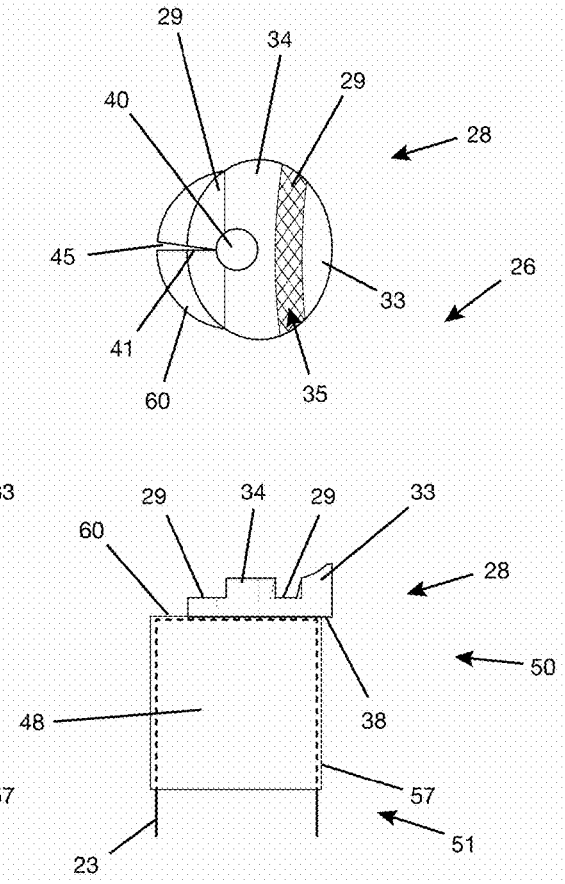
FIG. 9B is a side view and a top view of the apparatus of FIG. 9A coupled to an ear canal component having a square top.
Figure 9C:
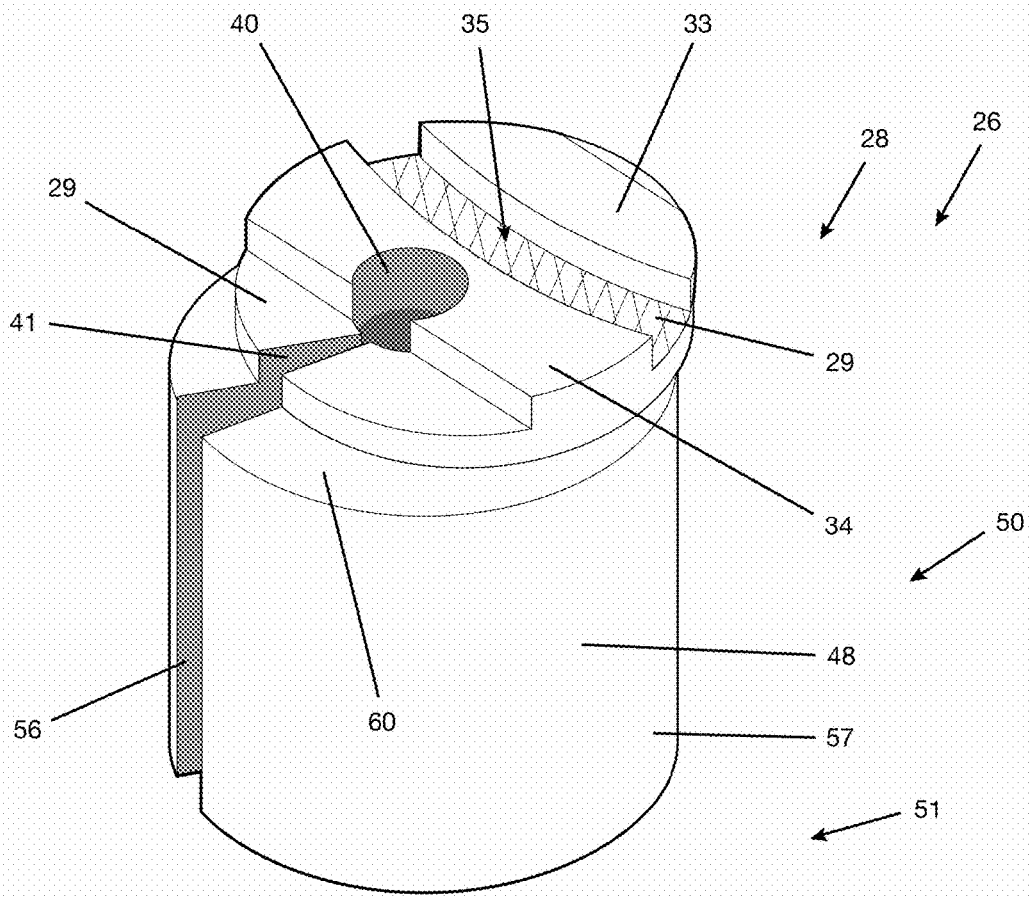
FIG. 9C is a perspective view of the apparatus of FIG. 9A.

In certain example apparatuses 26 the sidewall 48 is flush with cap 28 such that there is no edge or surface between the sidewall 48 and the cap 28 (see FIGS. 6A-6H). In other examples, the cap 28 includes a lower surface 38 positioned between the cap 28 and the sidewall 48 such that the sidewall 48 is inset from the outer edge 80 of the cap 28 (see FIGS. 7A-7C, 8A-8C, and 9A-9C). Referring to FIGS. 9A-9C, the sidewall 48 includes a top surface 60 adjacent to the cap 28.

Figure 6A:
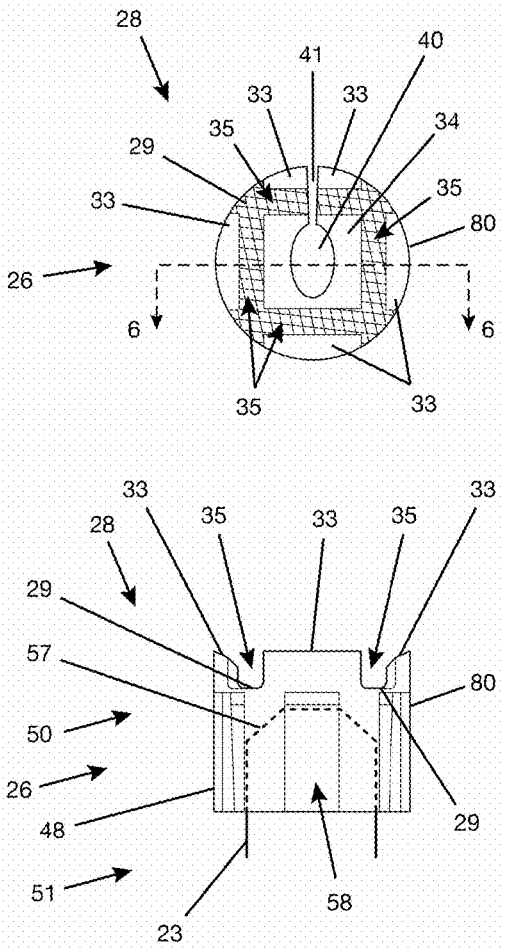
FIG. 6A is a side view and a top view of an example apparatus of the present disclosure coupled to an ear canal component having a rounded top.
Figure 6B:
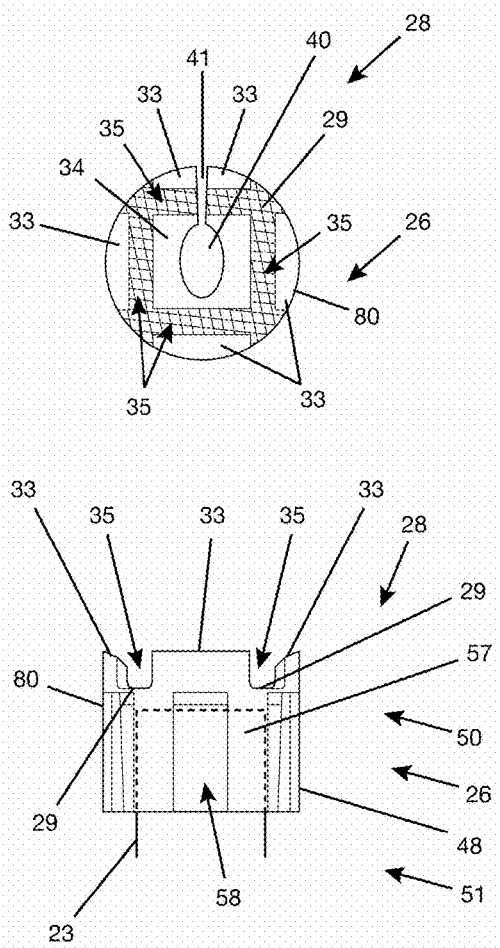
FIG. 6B is a side view and a top view of the apparatus of FIG. 6A coupled to an ear canal component having a square top.
Figure 6C:
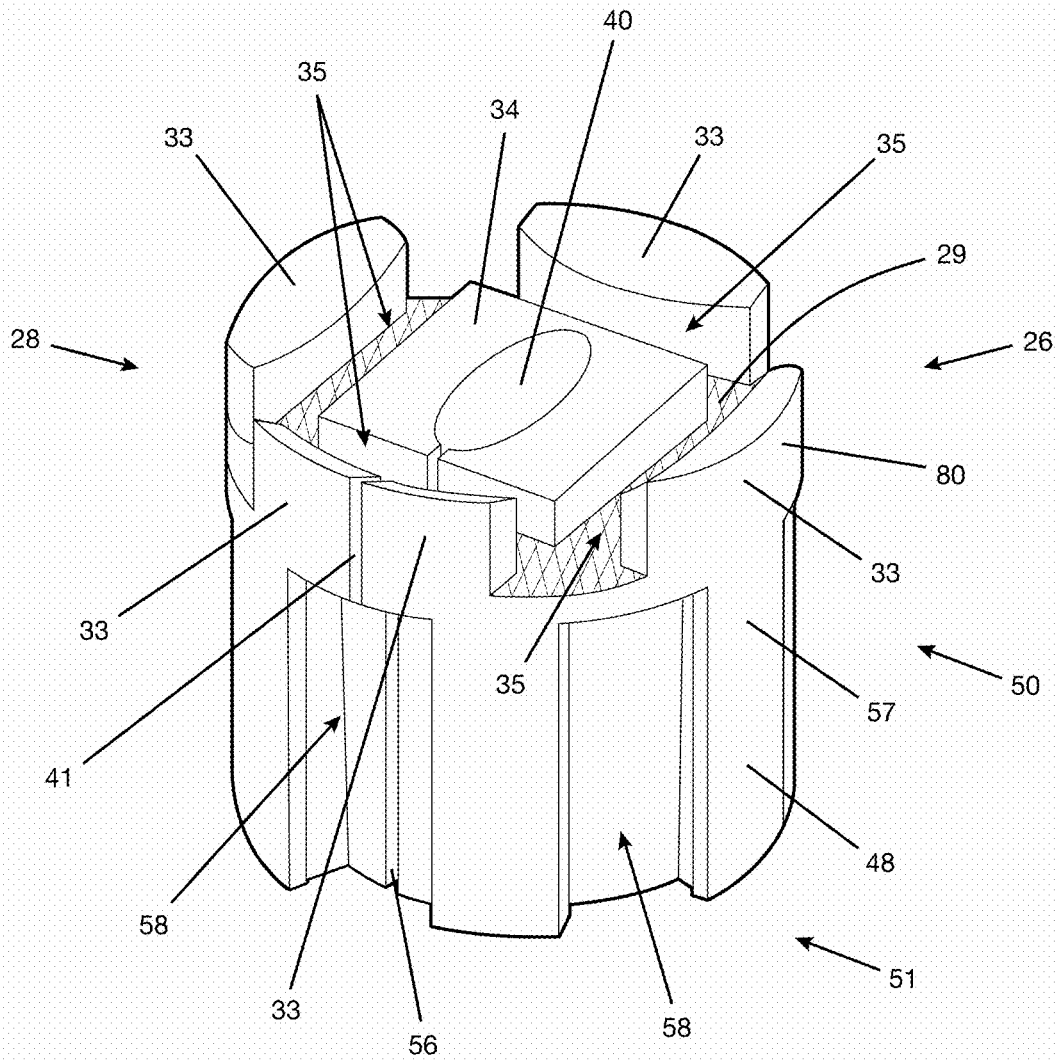
FIG. 6C is a perspective view of the apparatus of FIG. 6A.
Figure 6D:
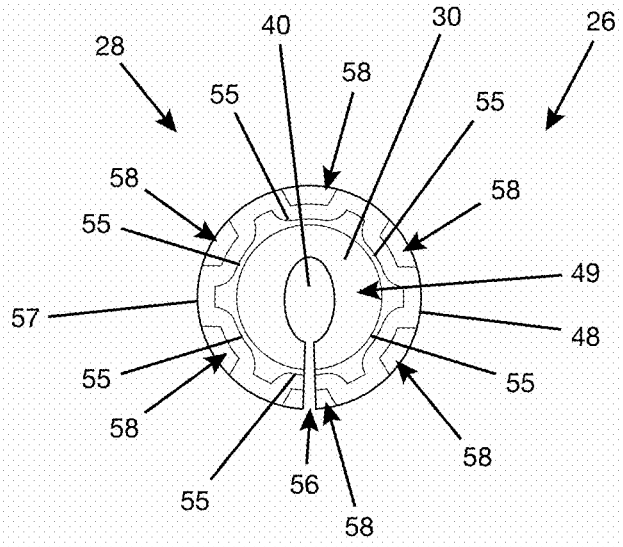
FIG. 6D is a bottom view of the apparatus of FIG. 6A.
Figure 6E:
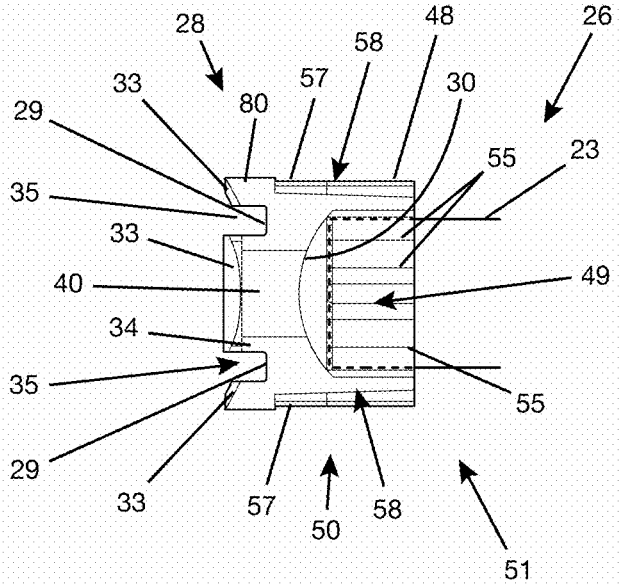
FIG. 6E is a cross section of the apparatus of FIG. 6A along line 6-6 on FIG. 6A.
Figure 6F:
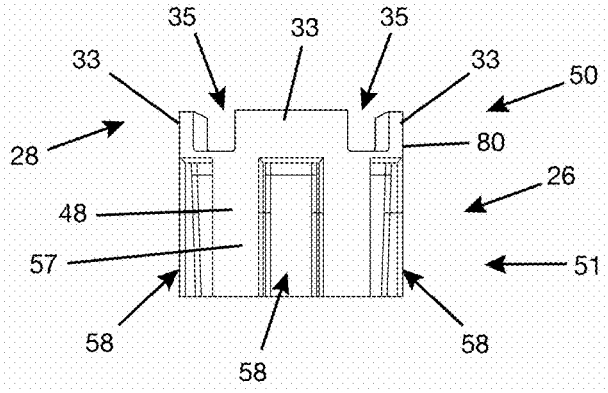
FIG. 6F is a back view of the apparatus of FIG. 6A.
Figure 6G:
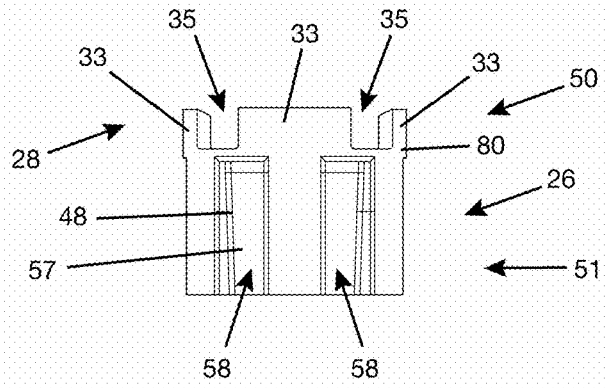
FIG. 6G is a side view of the apparatus of FIG. 6A.
Figure 6H:
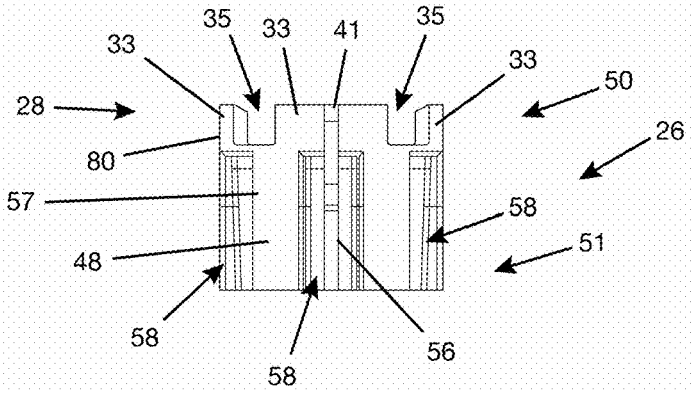
FIG. 6H is a front view of the apparatus of FIG. 6A.
Figures 7A, 7B:
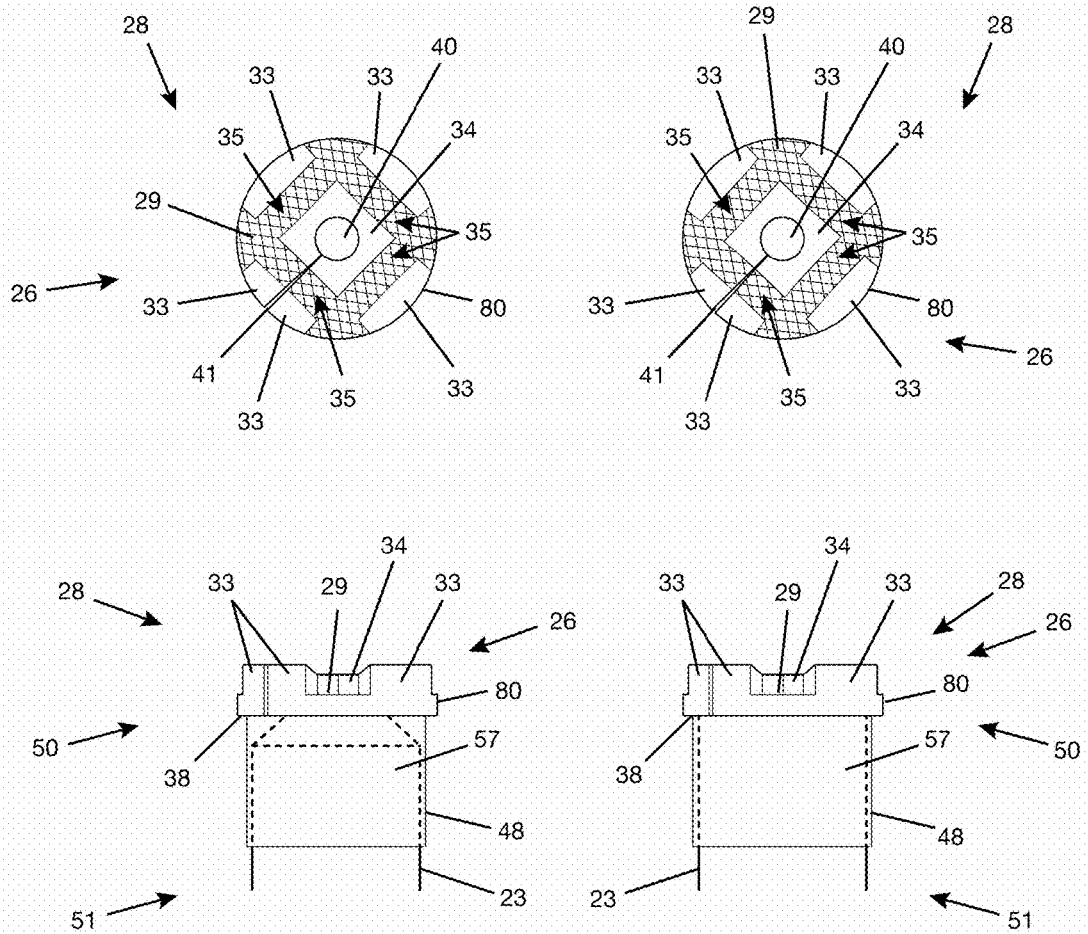
FIG. 7A is a side view and a top view of an example apparatus of the present disclosure coupled to an ear canal component having a rounded top.
FIG. 7B is a side view and a top view of the apparatus of FIG. 7A coupled to an ear canal component having a square top.
Figure 7C:
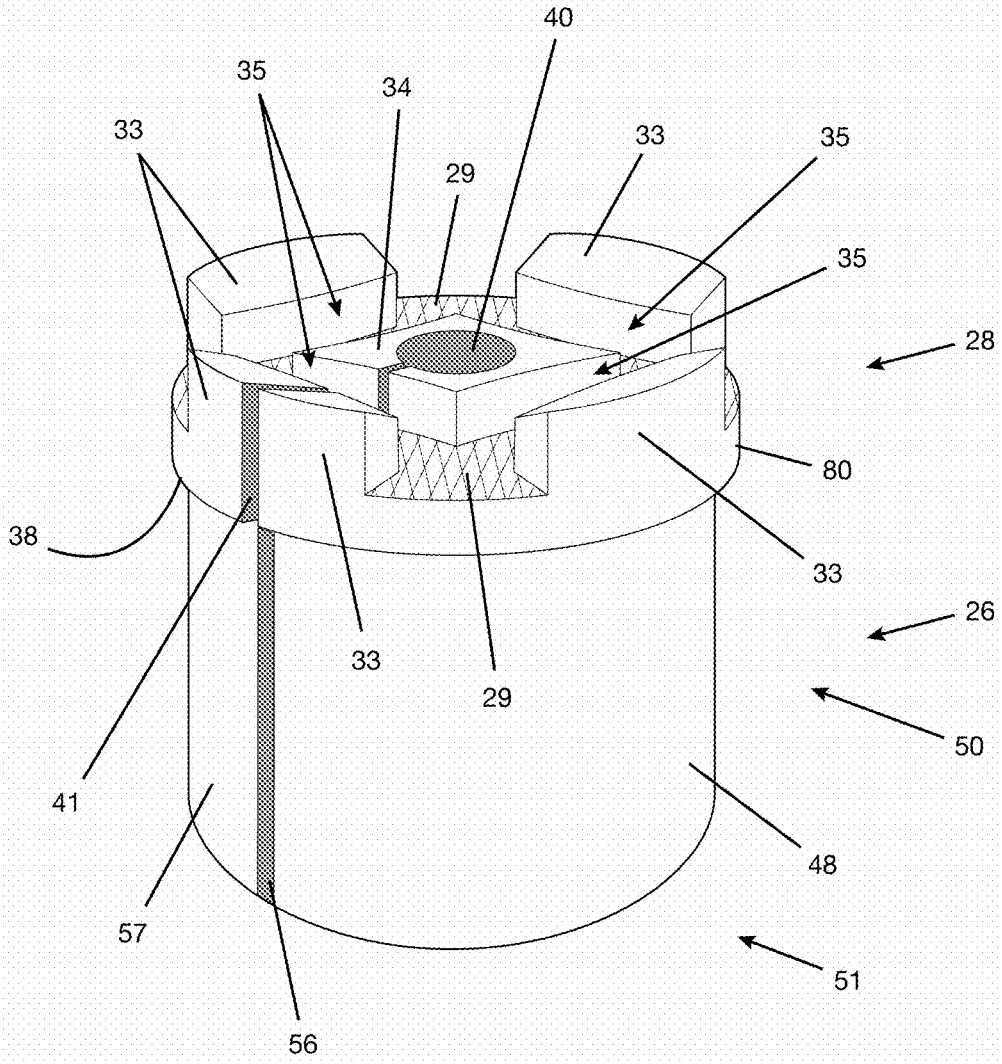
FIG. 7C is a perspective view of the apparatus of FIG. 7A.
Figure 8A:
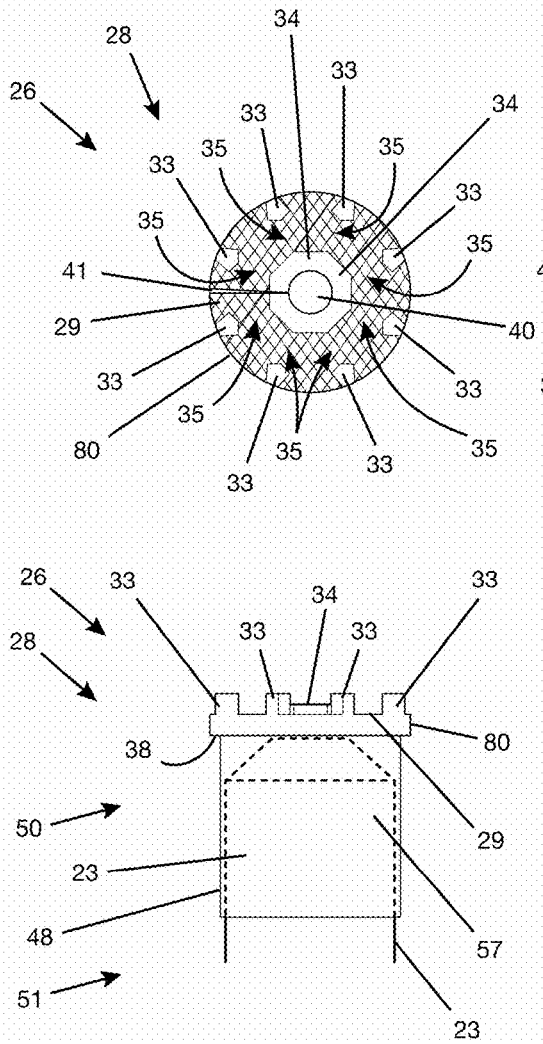
FIG. 8A is a side view and a top view of an example apparatus of the present disclosure coupled to an ear canal component having a rounded top.
Figure 8B:
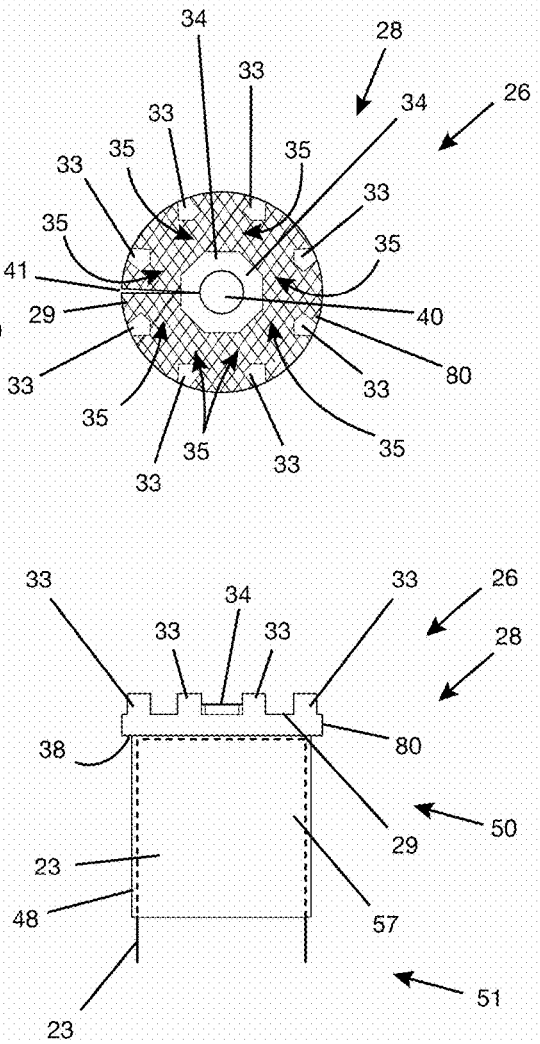
FIG. 8B is a side view and a top view of the apparatus of FIG. 8A coupled to an ear canal component having a square top.
Figure 8C:
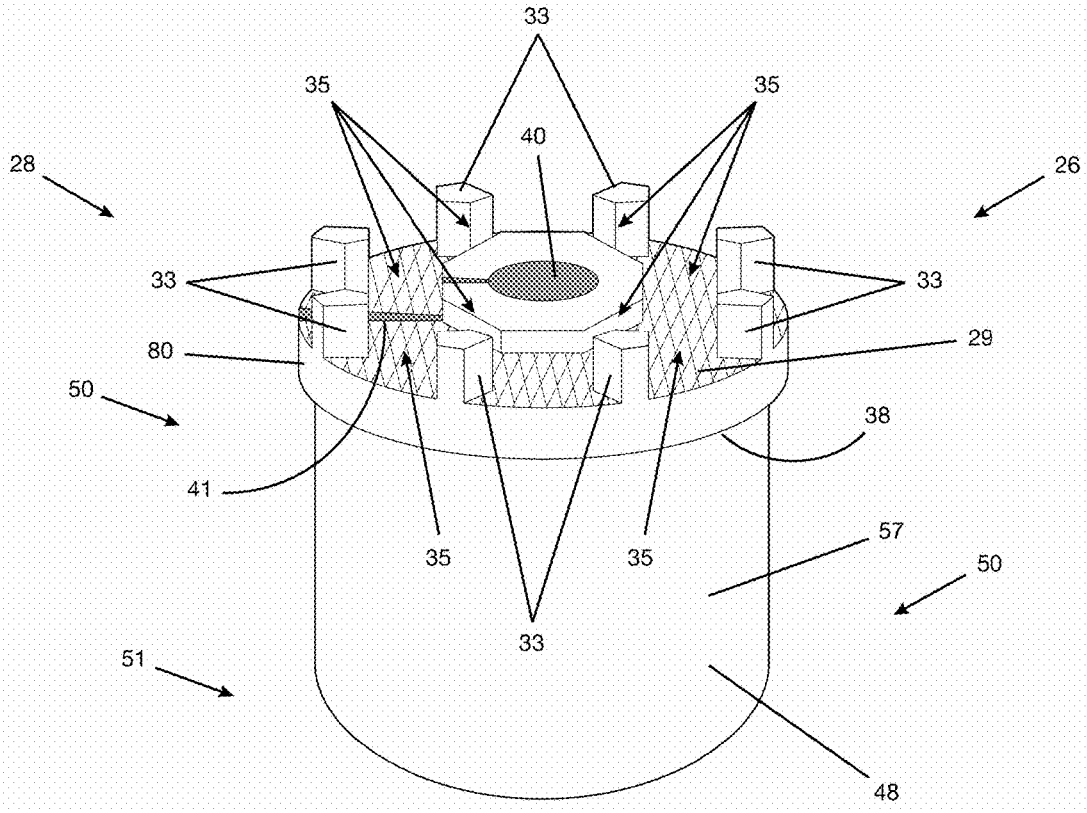
FIG. 8C is a perspective view of the apparatus of FIG. 8A.

The sidewall 48 includes a sidewall slit 56 that aligns with the cap slit 41 (see FIGS. 6C, 7C, and 9C). The sidewall slit 56 opens as the user elastically deforms the sidewall 48 to position the ear canal component 23 in the cavity 49. When the ear canal component 23 has been properly received in the cavity 49, the sidewall slit 56 returns to a closed position such that the ear canal component 23 is not easily moved from the apparatus 26 without an appropriate force. In a closed position, two opposite surfaces of the sidewall slit 56 can contact each other. In other examples, a space or gap may separate the two edges of the sidewall slit 56.

Figure 12:
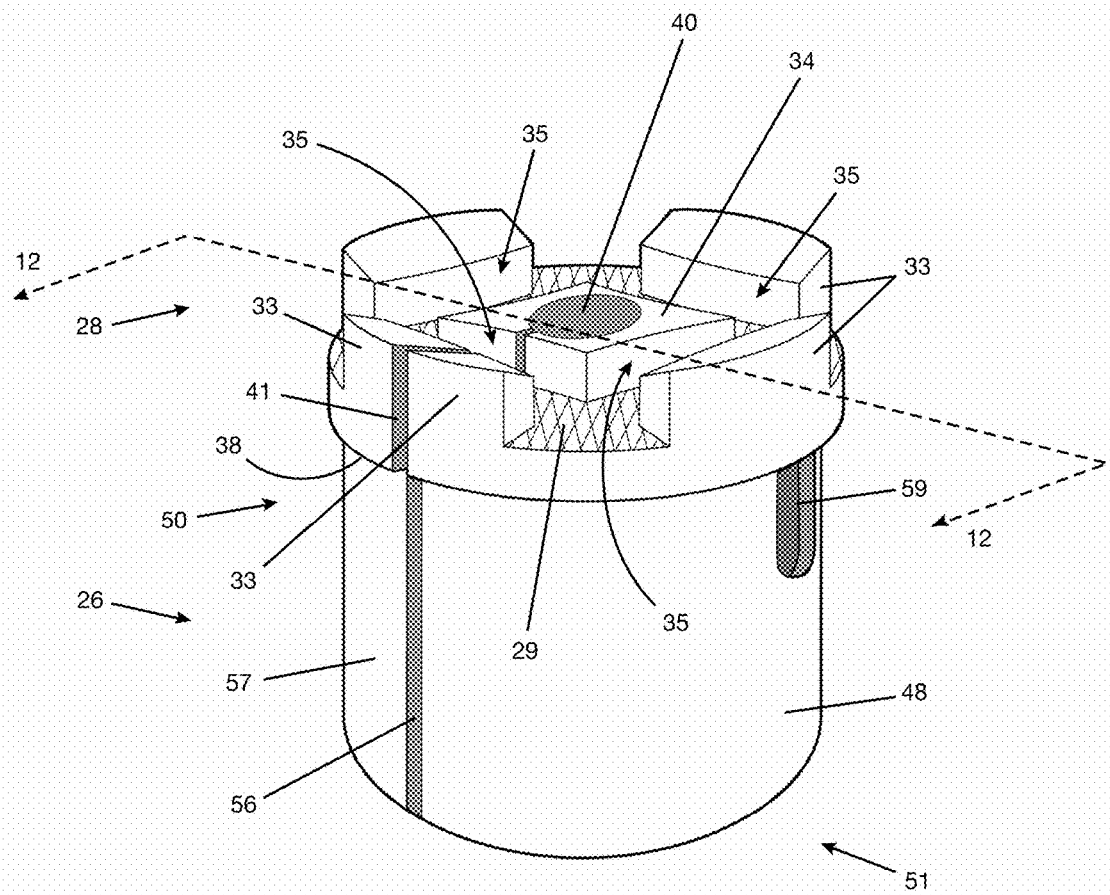
FIG. 12 is an example apparatus of the present disclosure.
Figure 13:
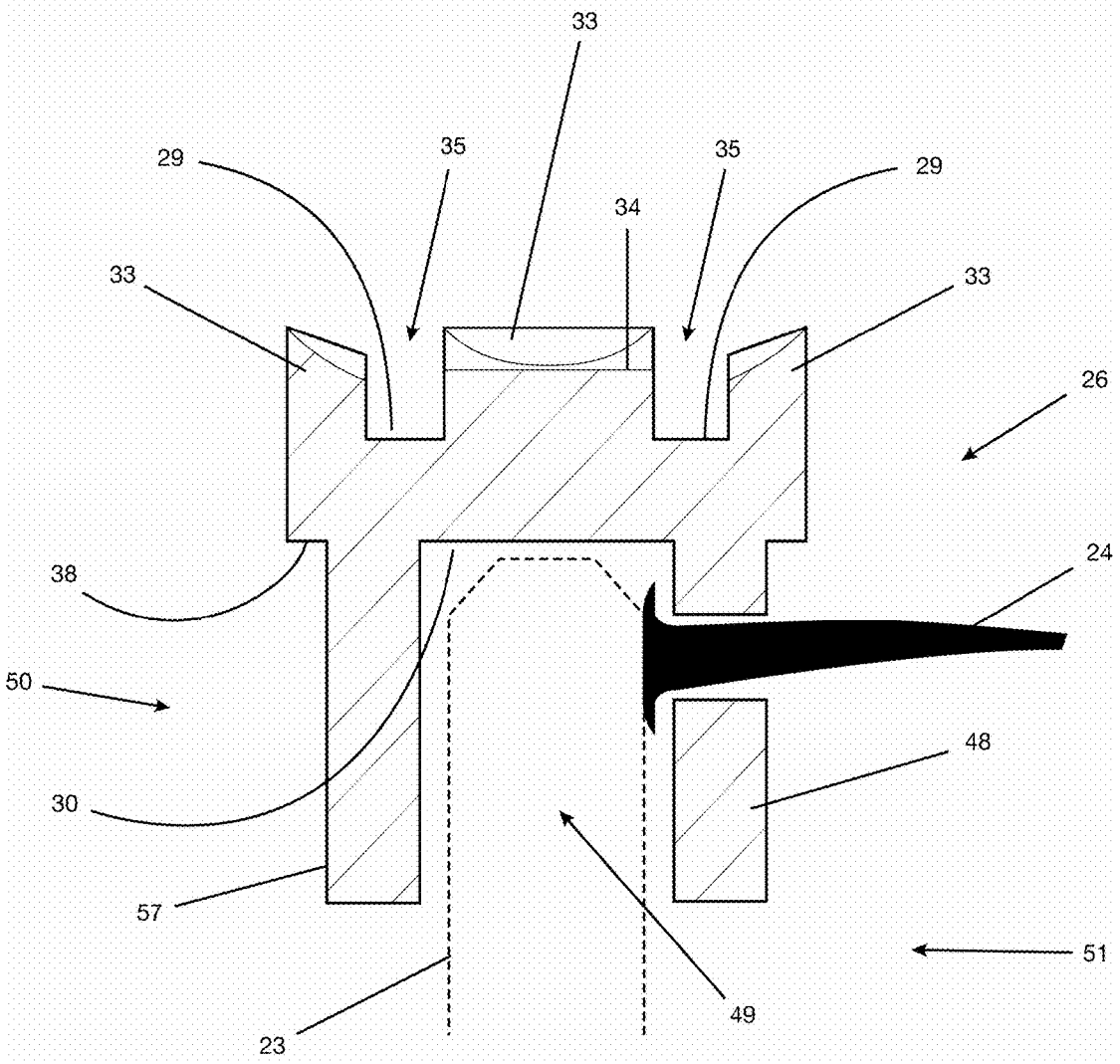
FIG. 13 is a cross section view of the apparatus of FIG. 12 along line 12-12 shown in FIG. 12.
Figure 14A:
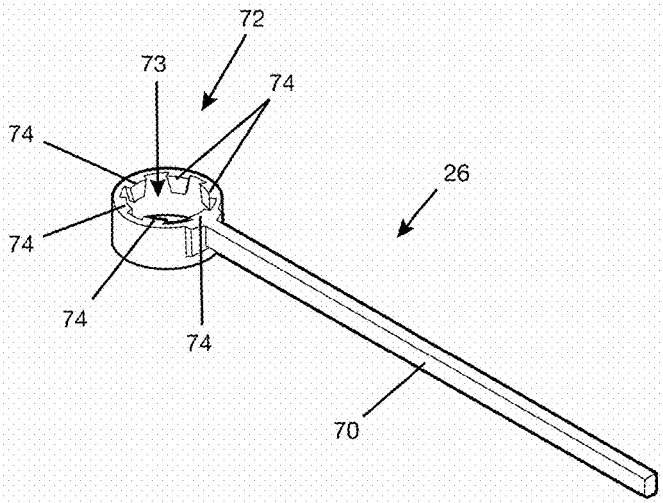
FIG. 14A is a perspective view of an example retention tail.
Figure 14B:
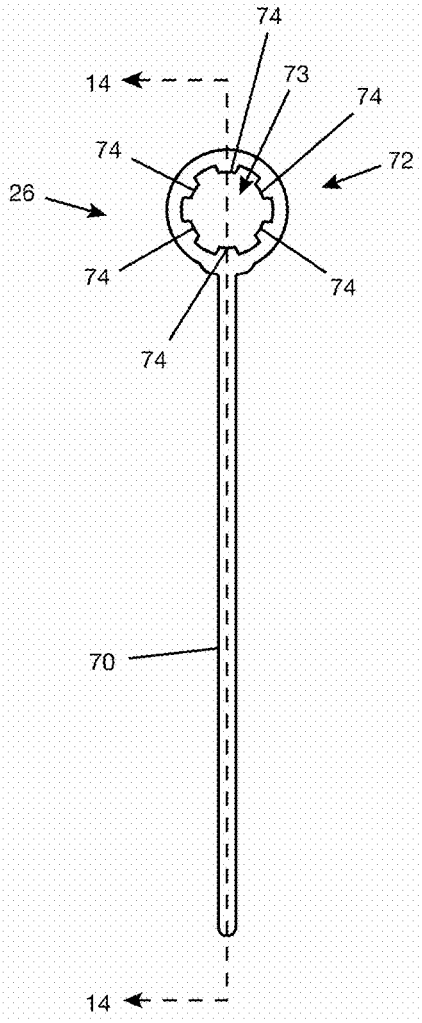
FIG. 14B is a top view of the retention tail of FIG. 14A.
Figure 14C:
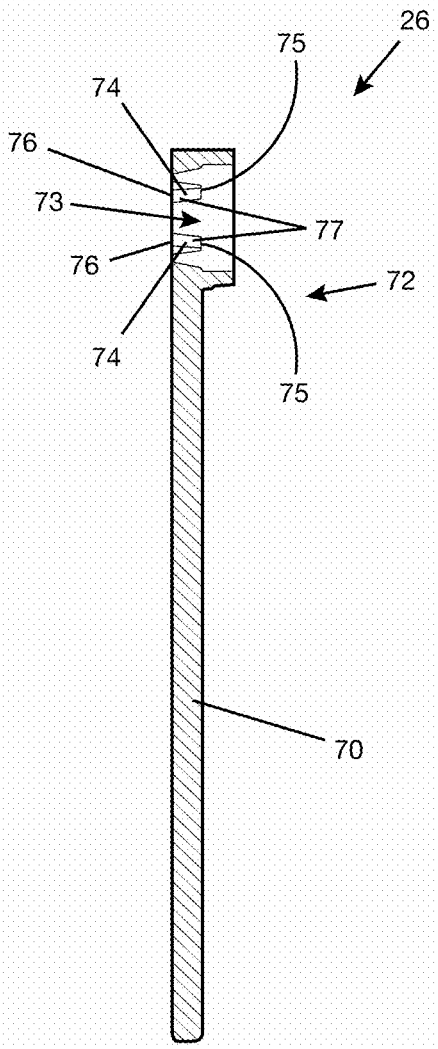
FIG. 14C is a cross section view of the retention tail of FIG. 14A along line 14-14 shown in FIG. 14A.
Figure 14D:
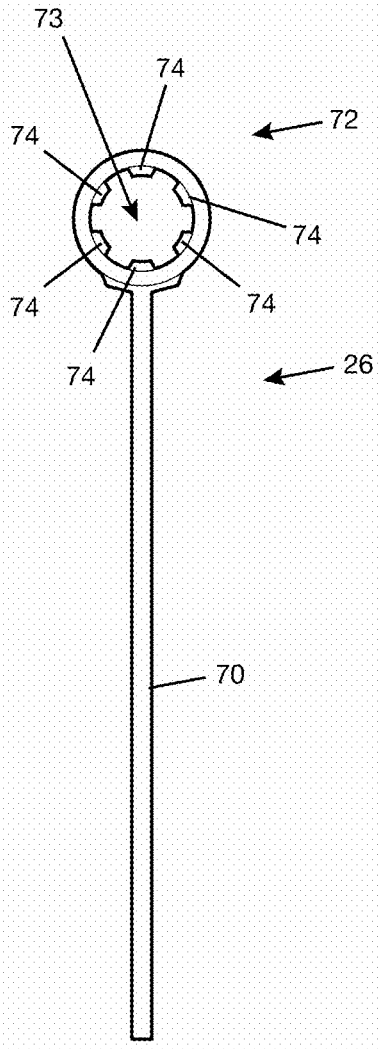
FIG. 14D is a bottom view of the retention tail of FIG. 14A.
Figure 14E:
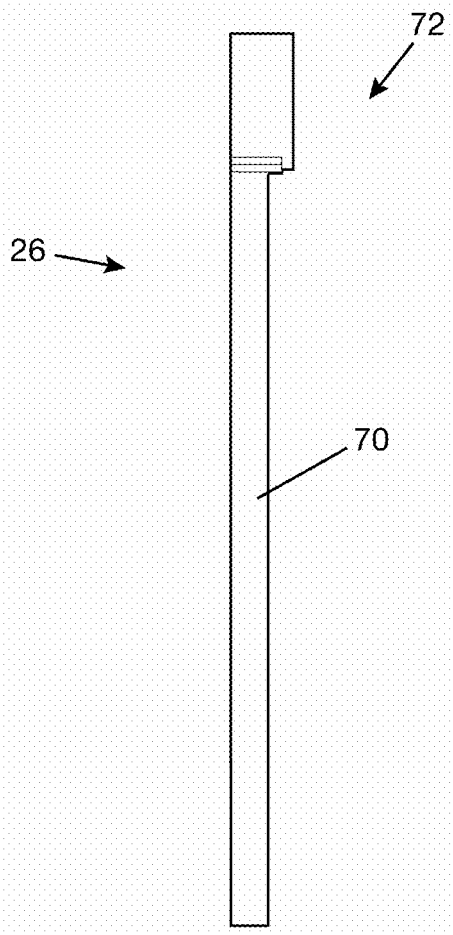
FIG. 14E is a side view of the retention tail of FIG. 14A.
Figure 14F:
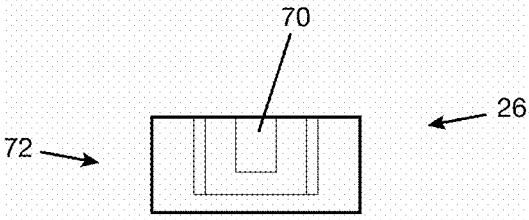
FIG. 14F is a front view of the retention tail of FIG. 14A.
Figure 14G:
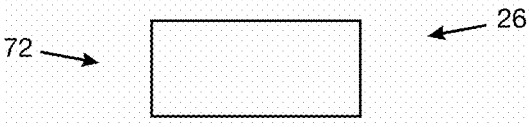
FIG. 14G is a back view of the retention tail of FIG. 14A.

The present inventor has also recognized that ear canals 15 that are longer and require deeper insertion of the hearing aid 20 or ear canal component 23 can cause the retention tail 24 (see FIG. 13) to not lie properly in the concha bowl 18 of the pinna (outer ear) and stick straight-out of the pinna because the ear canal component 23 is situated deep into the ear canal 15 such that the retention tail 24 is out of alignment with (e.g. not perpendicular to) the concha bowl 18. Accordingly, the apparatus 26 can be configured to increase the length of the ear canal component 23 to maintain proper alignment of the retention tail 24. Referring to FIGS. 12 and 13, the apparatus 26 defines a retention tail opening 59 that is configured to receive a retention tail 24 of the hearing aid 20. The retention tail opening 59 can be defined in the cap 28 and/or the sidewall 48. In certain examples, the retention tail opening 59 extends transverse to the connector hole 40.

Referring to FIGS. 14A-14G, 15, and 16, the apparatus includes a retention tail 70 that is removably coupled to the sidewall 48. The retention tail 70 is configured to retain the ear canal component 23 in the ear canal 15. The retention tail 70 includes a collar 72 that defines a bore 73 that receives the sidewall 48. The collar 72 comprises a plurality of fingers 74 that project into the bore 73 of the collar 72. The fingers 74 are received in the sidewall channels 58 defined by the outer surface 57 of the sidewall 48 (see FIG. 15 which depicts the retention tail 70 adjacent to the cap 28 and sidewall 48; see FIG. 16 which depicts the retention tail 70 coupled to the sidewall 48 such that the fingers 74 are received in the sidewall channels 58). Any number of fingers 74 can be included, and the fingers 74 can be any suitable size and/or shape (e.g. rectangular, circular, triangular, concave). In certain examples, the fingers 74 include a first end 75, a second end 76, and a sloped surface 77 that slopes inwardly from the second end 76 to the first end 75. The shape of the concha bowl 18 can vary, and some concha bowls 18 include deep valleys in which the retention tail 24 lays. In certain examples, the concha bowl 18 does not include a deep valley below the ear canal 15 and the retention tail 24 must lie in the upper portion of the concha bowl 18. The plurality of fingers 74 and sidewall channels 58 allows the user to position of the retention tail 70 in different positions relative to the sidewall 48 (i.e. the retention tail 70 can extend upwardly; the retention tail 70 can be positioned downwardly). The retention tail 70 can be indexed relative to the sidewall 48 such that the retention tail 70 can extend in a plurality of positions (i.e. the retention tail 70 can be indexed relative to the sidewall 48 such that the fingers 74 engage the sidewall channels 58 and the retention tail 70 extends in a selected position).

In certain examples, the retention tail 70 in permanently coupled and integral to the apparatus 26. In certain examples, the retention tail 70 is coupled to the ear canal component 23 such that the apparatus 26 does not include the cap 28 and/or sidewall 48. In this example, the retention tail 70 can couple to the ear canal component 23 as described with reference to the other components and features of the apparatus 26.

In certain examples, the apparatus for controlling and positioning a device in a body cavity apparatus comprises a cap configured to couple with the device such that the cap increases maneuverability of the device in body cavity as the device is positioned in the body cavity. The device is an ear canal component of a hearing aid, and the ear canal component is positioned in an ear canal. The cap includes a contact surface configured to be contacted by the user, and the contact surface is textured. The cap includes a gripping structure that projects outwardly from the cap. The cap includes a projection that projects outwardly from the cap and defines a groove between the projection and the gripping structure. The gripping structure is one of a plurality of gripping structures and the groove is one of a plurality of grooves such that the plurality of gripping structures defines the plurality of grooves between the projection and the plurality of gripping structures. The apparatus includes a sidewall coupled to the cap that defines a cavity configured to receive the ear canal component. The sidewall is annular and the cap further comprises a concave end wall that defines a closed end of the cavity. The sidewall comprises a plurality of ribs that project into the cavity and are configured to deform as the cavity receives the ear canal component such that the ribs elastically deform as the ear canal component is received in the cavity. The cap includes a cap slit and the sidewall includes a sidewall slit that aligns with the cap slit. The cap is configured to elastically deform as the cap couples to the ear canal component, and the cap slit opens and the sidewall slit opens as the ear canal component is received in the cavity. The apparatus includes a retention tail that is removably coupled to the sidewall. The retention tail has a collar defining a bore that is configured to receive the sidewall. The collar comprises a plurality of fingers that project into the bore, and the sidewall further comprises an outer surface that defines a plurality of sidewall channels that receive with the fingers thereby coupling the retention tail to the sidewall. The plurality of fingers includes an first end, a second end opposite the first end, and a sloped surface that slopes inwardly from the second end to the first end.

In certain examples, an apparatus for controlling and positioning an ear canal component of a hearing aid in an ear canal includes a cap configured to couple with the ear canal component such that the cap increases maneuverability of the ear canal component in the ear canal as the ear canal component is positioned in the ear canal; a plurality of gripping structures; a projection that defines a plurality of grooves between the projection and the plurality of a gripping structures; and an annular sidewall opposite the plurality of gripping structures that defines a cavity configured to receive the ear canal component. In certain examples, an ear canal component of a hearing aid that is positioned in an ear canal includes a cap configured to increase maneuverability and control of the ear canal component as the ear canal component is positioned in the ear canal.

In certain examples, an ear canal component of a hearing aid that is positioned in an ear canal includes an ear canal component having a cap configured to increase maneuverability and control of the ear canal component as the ear canal component is positioned in the ear canal; the cap can include a gripping structure projecting outwardly from the cap; the cap can include a projection projecting outwardly therefrom such that projection and the gripping structure define a groove therebetween; the cap can include a textured surface positioned between the projection and the gripping structure; and/or the gripping structure is one of a plurality of gripping structures and wherein the groove is one of a plurality of grooves such that the plurality of gripping structures defines the plurality of grooves between the projection and the plurality of gripping structures. In certain examples, the cap is integral with the ear canal component. In certain examples, the ear canal component of the hearing aid includes gripping structures and/or projections that extend outwardly from the ear canal component.

This written description uses examples to disclose the invention, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for coupling to a device placed in a body cavity, the apparatus comprising:

a cap extending along an axis and having a contact surface, a projection extending away from the contact surface in an axial direction, a gripping structure spaced apart from the projection and extending away from the contact surface in the axial direction, and a groove defined between the gripping structure and the projection; wherein the groove is configured to receive a fingertip that moves the device into position in the body cavity, and wherein the projection and the gripping structure bound the fingertip within the groove to thereby increase maneuverability of the device as the device is positioned into the body cavity.

2. The apparatus according to claim 1, wherein the cap has an perimetral edge, and wherein the gripping structure is positioned at the perimetral edge.

3. The apparatus according to claim 2, wherein the gripping structure has a sloped surface that radially slopes toward the contact surface and away from perimetral edge.

4. The apparatus according to claim 2, wherein the gripping structure is one of a plurality of gripping structures, and wherein the plurality of gripping structures are spaced apart from the projection and positioned along the perimetral edge to thereby define a plurality of grooves between the plurality of gripping structures and the projection.

5. The apparatus according to claim 4, wherein the cap has a hole that extends through the cap and a cap slit that extends through the cap between the hole and the perimetral edge to thereby define two opposing cap slit surfaces; and wherein the cap is configured to elastically deform when the cap is coupled to the device such that the cap slit opens and the opposing cap slit surfaces separate from each other.

6. The apparatus according to claim 4, further comprising a sidewall coupled to the cap and defining a cavity configured to receive the device, and wherein the sidewall axially extends away from the projection.

7. The apparatus according to claim 6, wherein the sidewall has an open end a opposite closed end and plurality of ribs that extend radially into the cavity, and wherein the plurality of ribs are configured to deform as the device is received in the cavity and thereby engage with the device.

8. The apparatus according to claim 6, wherein the cap has a hole that extends through the cap and a cap slit that extends through the cap between the hole and the perimetral edge to thereby define two opposing cap slit surfaces;

wherein the sidewall has a sidewall slit that extends through the sidewall and intersects the cap slit, and wherein the sidewall slit defines two opposing sidewall slit surfaces; and wherein the cap and the sidewall are configured to elastically deform when the cap is coupled to the device such that the cap slit opens and the opposing cap slit surfaces separate from each other and the sidewall slit opens and the opposing sidewall slit surfaces separate from each other.

9. The apparatus according to claim 6, further comprising a retention tail that radially extends from the sidewall and is configured to retain the device in the body cavity.

10. The apparatus according to claim 9, wherein the retention tail has a collar defining a bore that is configured to receive and couple to the sidewall.

11. The apparatus according to claim 10, wherein the collar comprises a plurality of fingers that extend into the bore; and wherein the sidewall further comprises an outer surface that defines a plurality of sidewall channels that mate with the fingers to thereby coupling the retention tail to the sidewall.

12. The apparatus according to claim 11, wherein each of the plurality of fingers includes an first end, a second end opposite the first end, and a sloped surface that slopes radially inwardly from the second end to the first end.

13. An apparatus for coupling to an ear canal component of a hearing aid placed in an ear canal, the apparatus comprising:

a cap extending along an axis and having:

a contact surface;

a perimetral edge;

a projection extending away from the contact surface in an axial direction;

a plurality of gripping structures spaced apart from the projection, extending away from the contact surface in the axial direction, and positioned along the perimetral edge;

a plurality of grooves defined between the projection and the plurality of gripping structures, wherein one groove of the plurality of grooves is configured to receive a fingertip that moves the ear canal component into position in a body cavity of the ear canal, and wherein the projection and one gripping structure in the plurality of gripping structures bound the fingertip within the groove to thereby increase maneuverability of the ear canal component as the ear canal component is positioned into the body cavity;

a hole extending through the cap; and a cap slit extending through the cap between the hole and the perimetral edge, wherein the cap slit defines two opposing cap slit surfaces, and wherein the cap is configured to elastically deform when the cap is coupled to the ear canal component such that the cap slit opens and the opposing cap slit surface separate from each other; and a sidewall coupled to the cap and axially extending opposite the plurality of gripping structures, the sidewall has a cavity configured to receive the ear canal component, and a sidewall slit that extends through the sidewall and intersects with the cap slit, wherein the sidewall slit defines two opposing sidewall slit surfaces, and wherein the sidewall is configured to elastically deform when the sidewall is coupled to the ear canal component such that the sidewall slit opens and the opposing sidewall slit surfaces separate from each other.

14. An ear canal component of a hearing aid that is positioned in an ear canal, the ear canal component comprising:

a cap contact surface having a center axis along which the ear canal component extends, a projection extending away from the cap contact surface in an axial direction, a gripping structure spaced apart from the projection and extending away from the cap contact surface in the axial direction, and a groove defined between the gripping structure and the projection wherein the groove is configured to receive a fingertip that moves the ear canal component into position in a body cavity of the ear canal, and wherein the projection and the gripping structure bound the fingertip within the groove to thereby increase maneuverability of the ear canal component as the ear canal component is positioned into the body cavity.

15. The ear canal component according to claim 14, wherein the cap surface has a perimetral edge, and wherein the gripping structure is positioned at the perimetral edge.

16. The ear canal component according to claim 15, wherein the gripping structure has a sloped surface that slopes toward the cap contact surface and away from the perimetral edge.

17. The ear canal component according to claim 16, wherein the cap contact surface is textured to thereby prevent fingertips contacting the cap contact surface from slipping thereon.

18. The ear canal component according to claim 14, wherein the gripping structure is one of a plurality of gripping structures, and wherein the plurality of gripping structures are spaced apart from the projection and along the perimetral edge to thereby define a plurality of grooves between the plurality of gripping structures and the projection.

* * * * *